US006148883A

United States Patent [19]

Wilson

[11] Patent Number: 6,148,883

[45] Date of Patent: Nov. 21, 2000

[54] WOOD TRIM SYSTEM

[76] Inventor: Bryan Alexander Wilson, P.O. Box 1886, Espanola, Ontario, Canada, P0P 1C0

[21] Appl. No.: 08/365,790

[22] Filed: Sep. 21, 1994

Related U.S. Application Data

[63] Continuation-in-part of application No. PCT/GB93/00583, Mar. 22, 1983.

[51] Int. Cl.[7] ..... B27F 7/00; E04F 19/04; F16B 5/00

[52] U.S. Cl. ..... 144/344; 52/211; 52/217; 52/288.1; 144/329; 144/353; 403/295

[58] Field of Search ..... 52/211, 98, 287.1, 52/288.1, 242, 718.02; 29/525.1; 403/231, 295, 403; 144/329, 353, 344; 269/41

[56] References Cited

U.S. PATENT DOCUMENTS

| | | | |
|---|---|---|---|
| 1,430,996 | 10/1922 | Horlin . | |
| 3,077,012 | 2/1963 | Speraw | 20/74 |
| 3,338,008 | 8/1967 | Sklar | 52/211 |
| 3,407,555 | 10/1968 | Pugh | 52/288.1 |
| 3,422,584 | 1/1969 | Howard | 52/98 |
| 3,570,202 | 3/1971 | Castellano | 52/211 |
| 4,008,549 | 2/1977 | Dobija | 52/287.1 |
| 4,642,957 | 2/1987 | Edwards | 52/242 |
| 4,663,906 | 5/1987 | Weinar | 52/211 |
| 4,845,911 | 7/1989 | Winston et al. | 52/456 |

FOREIGN PATENT DOCUMENTS

| | | | |
|---|---|---|---|
| 699318 | 12/1964 | Canada | 20/96 |
| 798009 | 11/1968 | Canada | 20/96 |
| 858766 | 12/1970 | Canada | 20/96 |
| 0 377 780 | 6/1989 | European Pat. Off. | E04F 19/04 |
| 1376369 | 9/1964 | France . | |
| WO 92/01847 | 2/1992 | WIPO | E04F 19/04 |
| WO 93/19273 | 9/1993 | WIPO | E06B 1/62 |

*Primary Examiner*—W. Donald Bray
*Attorney, Agent, or Firm*—Anthony Asquith & Co.

[57] ABSTRACT

Door frames, window frames, baseboards, corner mouldings, etc are trimmed with solid wood, eg oak, trim pieces. The trim pieces are fitted over splines which are screwed to the wall. A jig enables the splines to be located accurately in position. The spline includes no beads, snaps, or other features that would require the oak trim section to flex; instead, the trim is secured by the friction arising from the fit of the spline into a groove cut into the rear face of the trim section. In a variation, a pair of parallel grooves are provided, together with a corresponding pair of splines, which are mounted on a web.

24 Claims, 10 Drawing Sheets

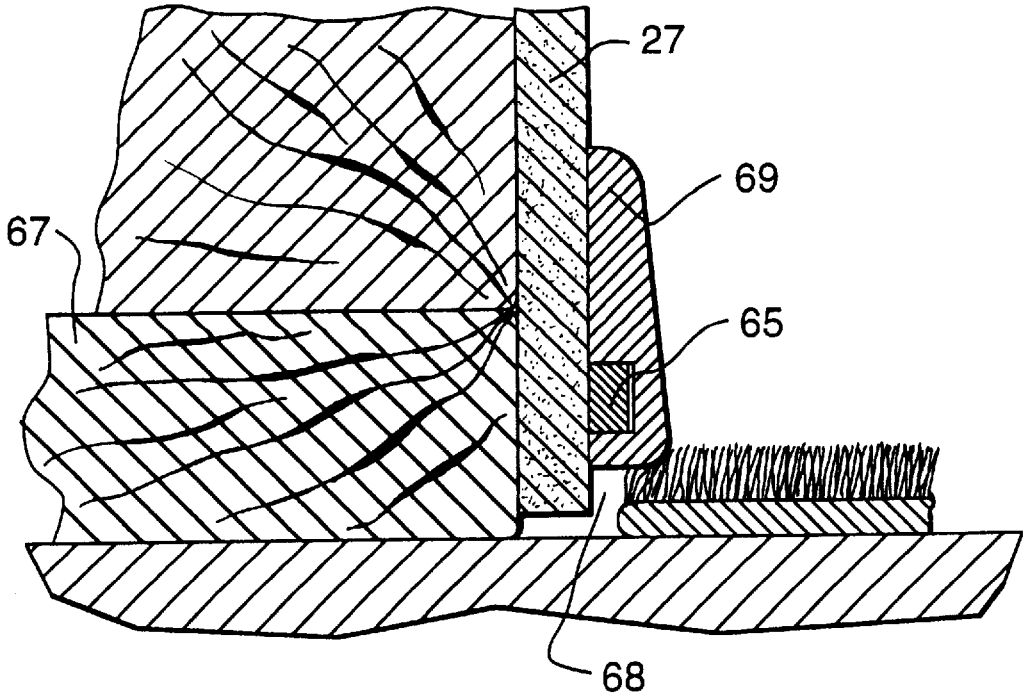
FIG.5
FIG.6.
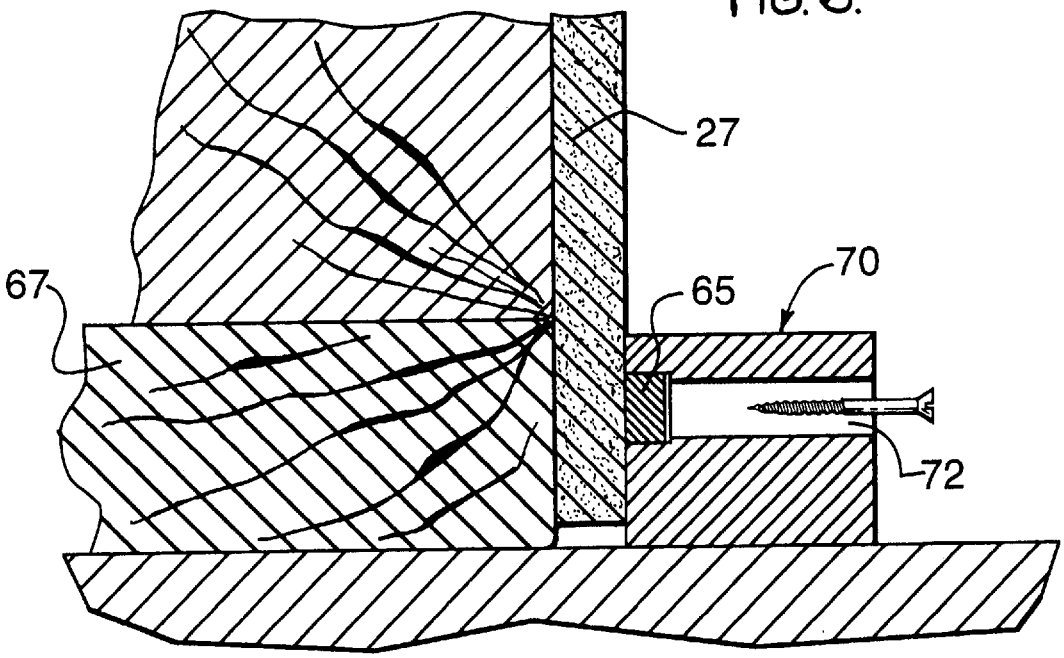

WOOD TRIM SYSTEM

This is a Continuation-in-Part of PCT/GB93/00583, filed Mar. 22, 1983.

This invention relates to wood trim, of the kind used to trim the edges of door frames and window frames, wainscotting, and also baseboards and skirting boards, in houses and other buildings.

BACKGROUND TO THE INVENTION

In the conventional manner of applying such trim, for instance around a door frame in a house, the carpenter cuts the lengths of trim, mitres the corners, and then nails the lengths of trim in place; then he drives the nail heads below the surface of the trim; he applies filler or stopper into the indentations; and leaves the filler to set. He returns later, and smooths down the filler. After that he applies stain, varnish, etc as required.

A good deal of care and attention is required of the carpenter when fitting conventional door trim. The door trim is very visible and noticeable, and if the job is done casually or carelessly the results can be most displeasing to the householder.

One problem with conventional trim is that finishing coatings cannot be applied to the trim until after the trim has been nailed up, and the nail-holes have been filled and smoothed. Especially when the trim is being applied to a new house the atmosphere is likely to be dusty, and dust can spoil the quality of the finish. Only a conscientious carpenter, working with a great care and attention, can be left with the job of applying and finishing the trim, especially if the trim is of the kind in which the decorative grain of the wood is to be displayed.

If the trim is to be painted, rather than left with the natural grain visible, the amount of attention needed to fill the nail holes, etc can be reduced. Consequently, it has been unusual for builders to provide wood trim in which the natural grain is left showing: the builder has far rather preferred to cover the trim over with paint, since the quality of craftsmanship needed to do that is rather lower.

The invention is aimed at providing a means for attaching wood-trim around a door frame, etc, which is far simpler for the carpenter than the above, and in which nothing (such as nail heads) mars the presentation-surface of the trim. It is an aim of the invention that the trim may be pre-finished, in-factory if desired, and applied to the wall in its finished form.

GENERAL FEATURES OF THE INVENTION

The invention provides a wood trim assembly, which is suitable for attaching solid wood door and window trim, wainscotting, baseboard trim, or the like to a wall. The assembly includes lengths of solid wood trim, and lengths of spline. Each length of wood trim is of constant cross-section along its length, as is each length of spline. The pieces of the trim are assemblable to the splines.

Each length of the solid wood trim includes a back face which is adapted to lie flat against the wall, and a decorative front surface. The shape of the cross-section of the solid wood trim includes a groove formed into the cross-section of the trim from the back face.

The spline is adapted to fit inside the groove in the trim, in that the cross-section of the groove is complementary in shape and size to the cross-sectional shape and size of the spline.

The spline is adapted to be fixed firmly to the wall, prior to the trim being assembled to the spline. The fit of the spline to the groove in the trim is such that, upon assembly of the trim to the spline, the spline being fixed firmly to the wall, the trim is assemblable over the spline by means of a manual (light) pounding action, whereby the trim, after assembly, remains firmly held in place by means of its frictional grip on the spline, and whereby the use of nails or glue to hold the trim is avoided.

The fact that the trim is held by a mechanical friction grip, and not by nails, nor glue, means that the trim is removable. This is an important feature of the invention, in that the trim can be taken off for such purposes as painting or papering the walls around a door frame, or for replacing a damaged piece of trim. Notwithstanding the fact that the trim is removable, the decorative surface of the trim is not subject to any compromise arising from the manner of attachment of the trim. The surface remains clear, whether the trim is removed and replaced often, or remains in place more or less permanently.

The fit of the groove to the spline, after assembly, across the width of the groove, preferably is between zero clearance and ¼ mm clearance.

Preferably, one of either the groove or the spline is tapered, to the extent that the clearance between the groove and the spline, upon presentation of the groove to the spline just prior to assembly is about ½ mm, on the basis that the groove is less than about 15 mm in width.

It is not intended that the wood trim should flex and snap over a bead of any kind, but rather that the tightness of the fit of the trim onto the spline arises because of the rigidity of the trim. For this reason, it is preferred that the cross-sectional shape of the trim, with the groove therein, is characterised as chunky and rigid.

The spline may be of wood or of plastic. If the latter, the cross-sectional shape of the spline may include resilient fingers which, upon assembly of the trim to the spline, engage, and press resiliently against, the sides of the groove.

The pieces of trim and the splines may be included as components of a kit, which also includes a jig for assisting in the accurate placing of the splines in the desired location on the wall.

The jig includes a spline holder, in which is formed a jig-groove, the jig-groove being complementary in cross-sectional size and shape to the spline. The jig is provided with through-holes, which are so positioned and arranged that screws can pass therethrough and through a spline positioned in the jig-groove, the through-holes in the jig being large enough that the heads of the screws can pass through the through-holes in the jig.

When the trim is being applied around the corners of a door frame, the jig includes two such spline holders, and the jig includes a brace for holding the two holders precisely set at right angles to each other. Preferably, the jig includes an abutment piece, which is so arranged as to provide an abutment for locating and positioning the jig flat against the jamb of a door frame.

Preferably, the abutment piece is no more than 2 mm thick, and is so located and arranged as to fit, in use of the jig, between the lintel of a door frame and the top of a door in the door frame.

When the jig is adapted for mounting wainscotting or baseboard trim, the groove is set a first distance from a first abutment surface on the jig, which is adapted to rest on the floor during use of the jig, and the groove is set a second distance from a second surface abutment which is adapted to rest on a carpet on the floor during use of the jig, the second distance being about 12 mm shorter than the first distance. This allows the jig to be used either on the bare floor, or with the room carpet in place.

Because the trim requires no nails etc to hold it in place, the trim can be pre-finished, ie the trim requires no painting etc after being assembled; therefore the ability to fit the trim accurately with the carpet in place, is highly convenient. (If the trim had to be finished, ie painted or varnished, after installation the prudent householder might wish to take up the carpet in any event.)

Optionally, the assembly includes a pair of the said grooves and a complementary pair of the said splines, the splines being linked by a web means, which is effective to hold the splines in a precise, spaced-apart, parallel side-by-side relationship.

Optionally also, the shape of the cross-section of the solid wood trim includes a cut-out which is suitable for receiving electrical wiring passing along the length of the trim, and the web is formed with an alignment means for aligning the wiring with respect to the web prior to assembly of the trim to the splines. This option is particularly advantageous when the two parallel splines are provided, because then it is simple to provide an alignment ledge or channel against which the wiring can be fixed, prior to assembly of the trim.

The fact that the trim is removable means that the addition of wiring later into a room can be accomplished very conveniently.

As mentioned, preferably the groove and the spline are plain-sided, in that the sides of the grooves and splines include no protrusions or beads or re-entrant aspects, and in that the fit of the trim to the spline is such that the wood of the trim is not required to flex resiliently, upon engagement. Wood might split if required to do that.

The invention also consists in a procedure for attaching solid wood door and window trim, wainscotting, baseboard trim, or the like, to a wall. The procedure includes the step of providing a length of solid wood trim, and lengths of spline; of providing a groove in the trim which is complementary in cross-sectional size and shape to the cross-section of the spline; of fixing the spline solidly to the wall by means of fasteners; of applying the trim over the spline, whereby the groove in the trim engages the spline; and of so dimensioning the groove and the spline that, upon engagement, the sides of the groove are in contact with the sides of the spline, thereby creating a frictional resistance to the dislodgement of the trim from the spline.

THE PRIOR ART

Of prior patent publications, DE-3,205,671 shows a trim attachment system where a spline engages a groove in a direction parallel to the wall. DE-3,842,687 shows a trim attachment system where a baseboard is arranged to stand-off from the wall. GB-2,239,281 shows a trim attachment system where a spline is a tight interference fit in a groove.

DETAILED DESCRIPTION OF PREFERRED EMBODIMENTS

By way of further explanation of the invention, an example of an embodiment of the invention will now be described with reference to the accompanying drawings in which:

FIG. 5 is a cross-sectional elevation of the foot of a wall, showing a baseboard attached thereto, which embodies the invention;

FIG. 6 is an elevation corresponding to FIG. 5, showing the use of a jig to assist in the positioning of the baseboard;

It should be noted that the scope of the invention is defined by the accompanying claims. The specific embodiments described and illustrated herein are merely examples of the invention, and the features of the examples are not necessarily the essential features of the invention.

Figure 1:
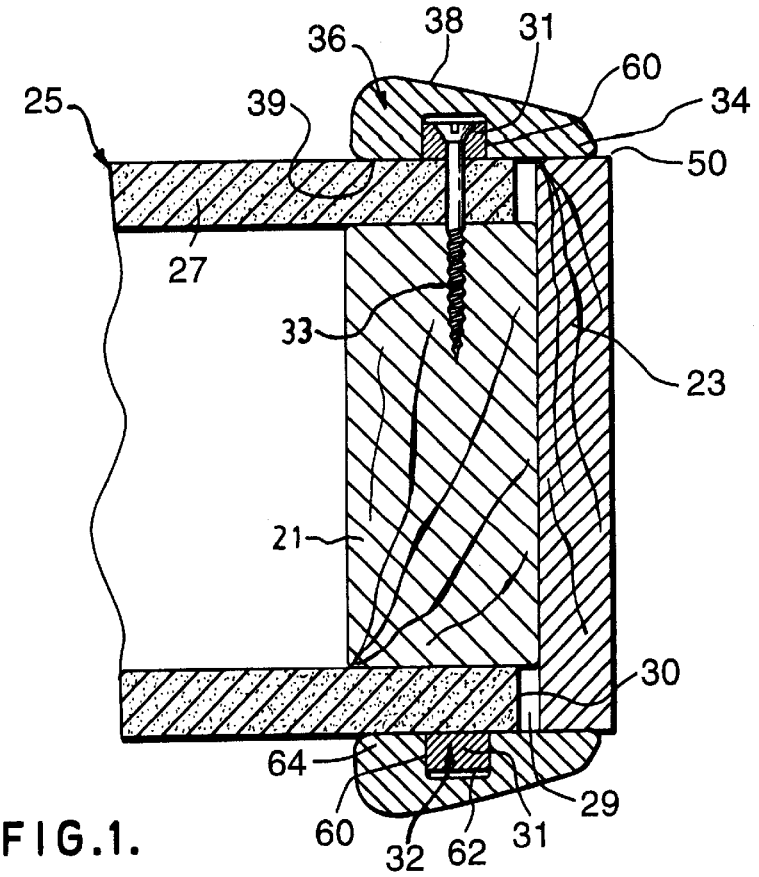
FIG. 1 is a cross-sectional plan view of an upright or side post of a door frame, which is trimmed by means of a wood trim assembly that embodies the invention.

FIG. 1 shows the upright or post of a conventional door frame 20, which includes a frame stud 21, and a jamb piece 23. The wall 25 of the room comprises wallboard or plasterboard 27 which is nailed or screwed to the stud 21 in the conventional manner. When the builder attached the plasterboard 27 to the stud, he left a gap 29 between the cut edge 30 of the plasterboard 27 and the jamb piece 23. Builders generally take no care to avoid leaving the gap 29, nor to cut the edge 30 neat and even, knowing the gap 29 will be covered by the trim.

In accordance with the invention, a length 31 of spline 32 is attached to the wall 25 around the door frame 20. The spline 32 comprises a rectangular strip of wood. The length 31 is attached to the wall 25 by means of screws 33 which pass through the plasterboard 27, and thread into the (wooden) stud 21 behind the plasterboard.

A length 34 of wooden finishing trim 36 is secured to the length 31 of spline 32. The wood of the trim 36 may be mahogany, for example, or oak, or other hard-wood that has a decorative grain, or a soft-wood such as pine or cedar, and the wood may be pre-finished with stain, varnish, paint, or other protective or decorative coating, as required. That is to say, the exposed face 38 of the trim, which will be exposed to view after installation of the trim, is pre-finished: it does not matter whether the unexposed back face 39 is pre-finished, since the back face 39 lies hidden, in contact with the wall 25, after installation. The invention is particularly suited to trim in which the grain of the wood will show through the finish, since these are the most difficult trims to install by other means.

Figure 3:
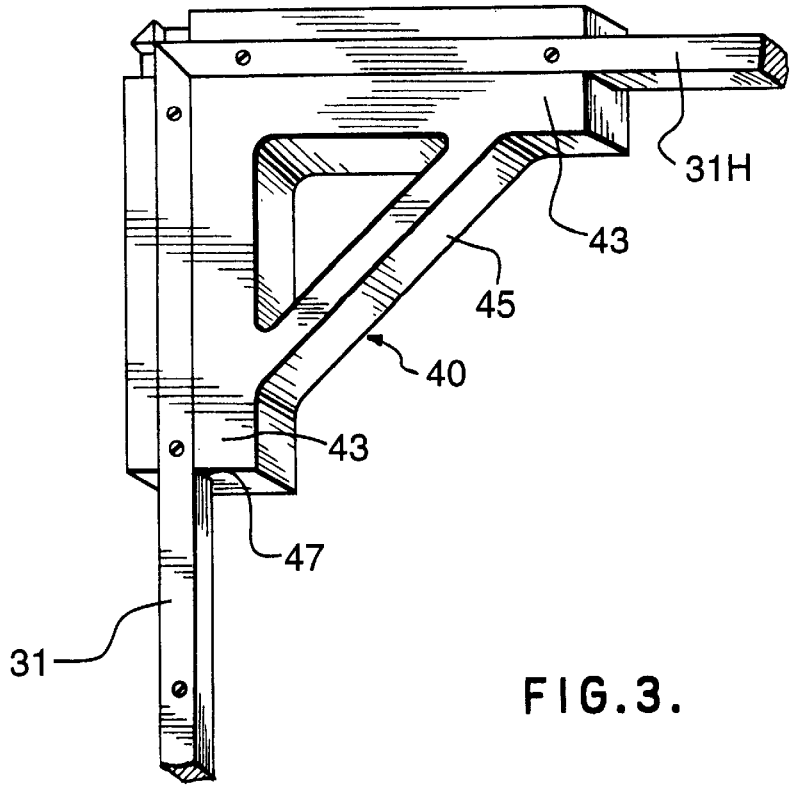
FIG. 3 is a pictorial view of a fitting jig, which is used to assist in correctly locating the components of the trim assembly of FIG. 1.

FIG. 3 shows a jig 40, The jig 40 comprises two spline holders 43 which lie at right angles to each other. The spline holders 43 are held rigidly precisely to the right angle by means of a triangulating brace 45.

The spline holders 43 are provided with jig grooves 47, for receiving the pieces 31 of spline 32 which are to be attached to the wall 25. The pieces 31 are pre-cut to length, and corner-mitred before being placed in the jig 40. The jig, with the two pieces 31 held in the jig grooves 47, is then presented to the door frame. FIG. 3 in fact shows the view of the jig and splines as seen from the door frame side.

An abutment piece 49 on one of the holders 43 allows the jig to be aligned straight with respect to the jamb piece 23. The corner 50 of the jamb piece (FIG. 4) tucks into the crook between the abutment piece and the holder 43. The carpenter slides the jig up the jamb piece 23 until the end 52 of the abutment piece 49 engages the undersurface 54 of the lintel 56 of the door frame 20. It is a very simple matter for the carpenter to place the jig in this position, and then to hold the jig in place.

The spline holders 43 are provided with holes 58. The holes 58 are large enough in diameter that the heads of the screws 33 can pass therethrough. Countersunk holes 59 in the spline pieces 31, for receiving the screws 33, may be prepared prior to the pieces being placed in the jig grooves 47, or the holes 59 may be drilled and prepared through the (large) holes 58.

With the jig and spline pieces in place, screws 33 are inserted through the holes 59, access to the screws being had through the clearance holes 58 in the jig. Once the screws have been tightened into the stud 21, and into the corresponding crosspiece 60 to which the lintel 56 is attached, the jig may be withdrawn, leaving the two pieces of spline screwed to the wall, the angle between the two pieces being exactly a right angle.

The angle between the jamb 23 and the lintel 56 will probably not quite be an accurate right angle, in a real house. It is one of the banes of applying trim that the carpenter may be perfectly accurate in mitring the trim pieces at exactly 45 degrees, but a slight out-of-squareness misalignment of the door frame makes it look as if an amateur had cut the mitres. The appearance of even a slight such mismatch of the mitred corners is quite obtrusively noticeable to the householder. It takes a good deal of skill on the part of the carpenter to avoid the appearance of mismatch of the mitres.

By the use of the jig 40, as described, the splines 31,31H in the corner of the door frame are always set precisely at a right angle, irrespective of whether the door frame is perfectly square. This means that, so long as the corresponding trim pieces are mitred accurately, the mitre will always appear neat and accurate, even if the door frame is (slightly) misaligned.

Figure 2:
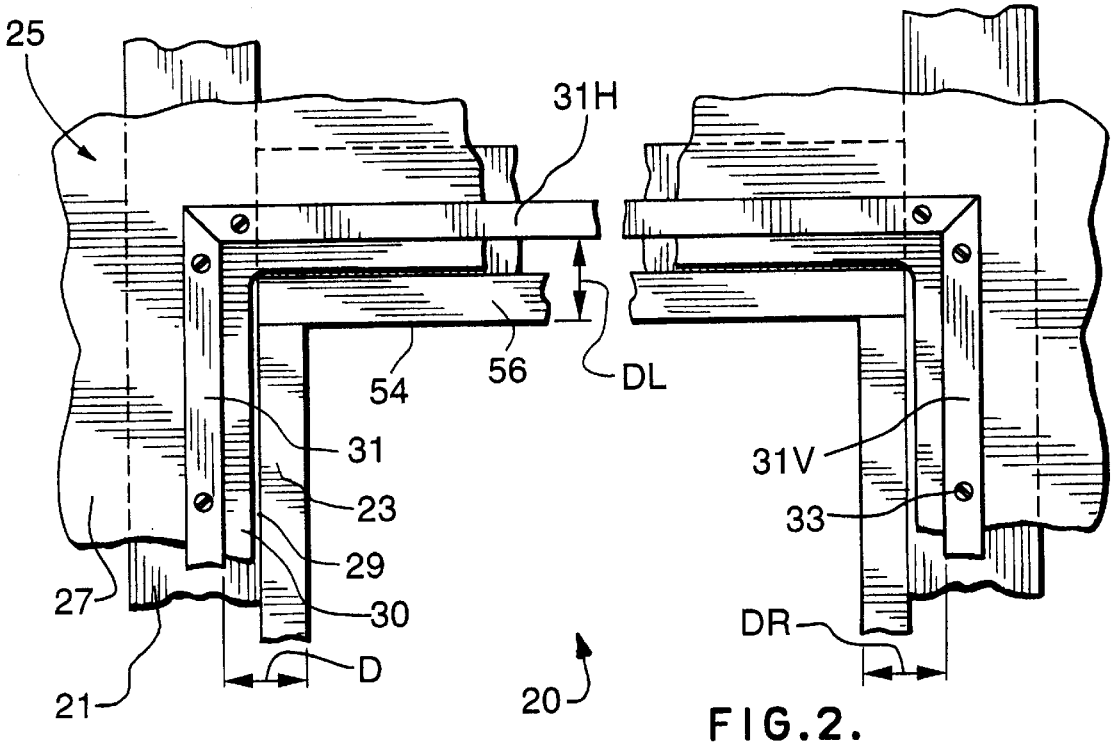
FIG. 2 is a front view of the door frame and trim assembly of FIG. 1, in which some of the components are removed.

The use of the jig also ensures that the spline is offset accurately a distance D (FIG. 2) from the corner 50 of the jamb, and a distance DH (which is equal to D) up from the surface 54 of the lintel 56.

When the jig 40 is removed, the vertical piece 31 of spline is left attached to the wall around the doorframe, but only the top two or three screws have actually been inserted (since the length of the spline holder 43 is only 40 or 50 cm. The lower portions of the piece 31 of spline at this point are not yet attached.

In addition to the angle between the jamb 23 and the lintel 56 not being quite square, it often happens that the jamb 23 is not quite straight, or is not quite vertical. The length 31 of spline protruding downwards therefore may not naturally align itself exactly the distance D in from the corner 50 of the jamb, all the way down the jamb, right to the bottom thereof. Similarly, the right hand end (FIG. 2) of the horizontal piece 31H of spline may not naturally lie a distance DL above the undersurface 54 of the lintel uniformly all the way along the lintel.

Therefore, the carpenter should use a ruler or the like to set the spline 31 a distance D accurately down the door frame, as he inserts the screws in that spline.

Once the corner between pieces 31 and 31H has been set to a precise right angle, using the jig, and the splines secured at the corner with the first of the screws, the rest of the fixing of the piece 31 can be carried out easily and accurately.

The carpenter will usually have to bend the spline 31 slightly in order to make the spline conform to the accurate right angles and the "constant-D" requirements, if the door frame 20 is not quite perfectly straight and square. The spline itself is easily able to bend this small amount, but once the spline is screwed to the wall the rigidity of the wall is added to the spline, and the screwed-on spline therefore resists being bent any further (or straightened). Whatever slight curvature is built into the spline 31 as the screws 33 are inserted is therefore locked into the spline, with immense rigidity.

It follows therefore that the wood trim piece 34, when it in turn comes to be assembled to the spline, must conform to the same curvature, if any, that was built into the spline 31 in order to make the spline lie a uniform distance D from the door frame. The trim itself has a substantial rigidity in the plane in which the dimension D is measured: as the trim is forced to adopt a position of slight bending to conform to the misalignment of the door frame, quite heavy contact forces can arise between the trim and the spline, at the points where they touch. The friction arising at these points aids in preventing the trim from coming off the spline.

In fact, in order to assemble the trim 36, the groove 60 in the trim is first "started" over the spline 31 at one end, and then the trim has to be forced over the rest of the spline by a light pounding action, such as can be applied by a person striking the trim with the side of the closed fist. The force required to apply the trim onto the spline is reflected in the force it takes to remove the trim from the spline.

Of course, if the spline 31 were to be nominally too loose in the groove 60, the spline might be found to be still loose in the groove even after the spline has been bent to conform to the doorframe, especially when the door frame 20 is particularly straight and square. The nominal fit of the groove to the spline, and the tolerances on the fit, should be such that the groove has no more slack than about ¼ mm on the spline.

Thus, although at any one cross-section there may be a slight clearance between the groove 60 and the spline 31, nevertheless the trim has to be pounded onto the spline; and, having been pounded on, the trim is highly resistant to being dislodged therefrom.

The sides of the groove 60 can therefore be expected to be in firm, friction-generating contact with the sides of the spline 31, even though the groove is nominally clear on the spline. It should be noted that this aspect only applies to the width of the groove, ie the measurement parallel to the plane of the wall. The floor of the groove should be well clear of the corresponding front face 62 of the spline 31, in that the spline must not be allowed to "bottom" inside the groove.

It is found, in fact, that very few door frames are precisely square, to the extent that the spline 31 is never quite straight. Therefore, there is invariably some degree of misalignment between the spline and the trim, by means of which the trim is caused to grip the spline firmly.

If the trim were too slack on the spline, of course the trim would fall off, and that should be avoided; it is not intended, in the invention, that the trim should be glued onto the spline. It is an aim of the invention to provide a trim that can be removed and replaced, for such purposes as painting or papering the walls of the room.

The task of removing trim for papering is very rarely undertaken with conventional trims, especially those in which the grain shows through. A decorator would have to take care not to damage or crack the wood during removal thereof, which is almost impossible trying to extract nails, and it would also be very difficult afterwards to mask the new nail heads, and to match any fresh finish that was applied to the trim. Room decoration is generally carried out with the trim remaining in place.

The system as described however makes it very simple to remove the trim for decorating purposes. A person can insert a blade or the like under a place on a piece of the trim where any slight consequent marring of the wood would not be noticed, and once started then the trim can be pulled progressively free of the spline. In doing this, even a careless person can undertake not to damage the trim in any way that would show. With the trim removed, the tasks of painting or papering the wall are very much simplified.

It is intended that the fit should be such that the trim can be easily applied to the spline by a light pounding action. With such a fit the trim cannot be removed by a direct pull, by a person using his fingers, but the trim can in fact easily be removed, as mentioned, by prying or levering the trim off the spline, starting at one end. A recess may be provided in each piece of trim to enable a pry bar to be inserted for removal purposes. Again, only minimal care is required to avoid damaging the exposed surface of the trim when using a pry bar in this manner. The recess should not be visible after the trim has been installed: a recess located on top of the horizontal piece 31H of trim would be unobtrusive enough; and once that piece has been removed the upper ends of the vertical pieces are exposed and can receive the pry bar.

In securing the horizontal piece 31H of trim, the following procedure may be followed. The left end (FIG. 2) of the piece 31H was screwed to the wall while the jig 40 was in place, leaving the right end, which has been already cut to size, and its extremity mitred, free.

Just as an important factor in fitting the first corner, as described, was to keep the two spline pieces 31,31H accurately at right angles, so that same factor is important in the opposite corner. Therefore, before screwing the right end of the piece 31H to the wall, the jig should be fitted over the right end of the piece; and the corresponding vertical piece 31V of spline that is to run down the right side of the door should be assembled into the jig. The carpenter should then take care to align the right corner as squarely as possible with the door frame.

Where the mitres in the trim and the spline are pre-cut to fit a door of a given nominal width, it will often happen that the actual door is a millimeter or so wider or narrower than the trim and the (accurately matching) spline. The result is that the dimension DR at the right side of the door may not be quite the same as the corresponding dimension D. This is not too critical, in that a (small) difference between D and DR would not be apparent to the householder except under close scrutiny: what should be avoided, however, is for the dimension DR not to be uniform over the whole height of the door frame. Thus, once DR has been set by the use of the jig at the top of the right side of the door frame, that same value of DR should be set (by measurement) all the way down the door frame.

This procedure is much easier to carry out than to describe, and in fact very little skill and craftsmanship is required of the person actually screwing on the splines in this manner.

Usually, installation of the splines will be carried out with the door itself not in place, for example when the builder of the house is using the system. The hinges are removed, so that there is no difficulty of the presence of the hinges preventing the jig from lying flush against the wall around the frame. However, it is possible to arrange the jig to be usable without the door being removed, and in fact with the door closed. In this case, the abutment piece 49 has to be thin enough to fit into the crack between the top of the door and the lintel. A metal abutment piece, of 1 mm or so thickness may be used for this purpose. (If the door were so tight under the lintel that even so thin an abutment piece would not fit, then the door would have to be taken off.) Thus, the system as described may be used, with the jig, in an already existing house, on a retro-fit basis, without taking the doors off.

Figure 4:
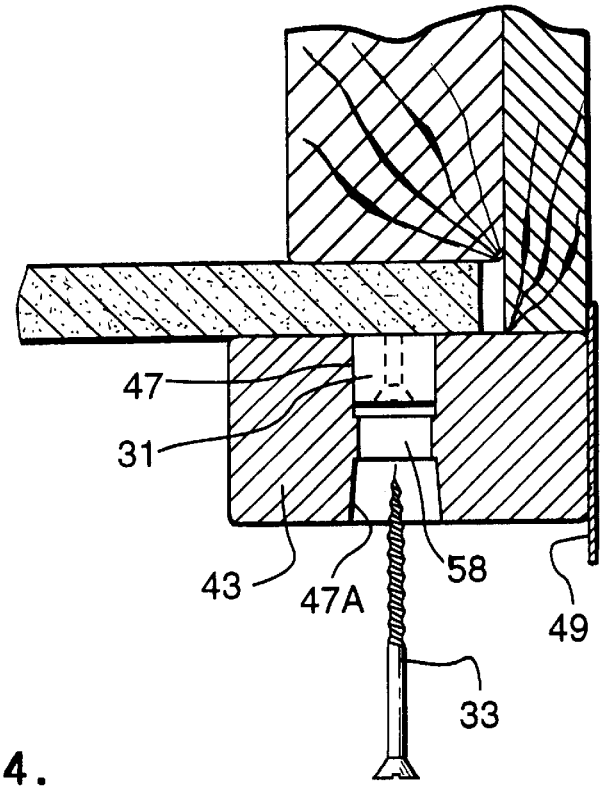
FIG. 4 is a cross-sectional plan view corresponding to FIG. 1, showing the jig of FIG. 3 in place on the door frame.

As shown in FIG. 4, the jig 40 is provided with spline-receiving grooves 47,47A on both sides. This allows the jig to be used either way round, ie on both corners on both sides of the door.

The cross-sectional shape 64 of the trim 36 is of a generally chunky character, with no slender or flimsy aspects. The cross-section 64 of the trim is, for the purposes of the invention, quite rigid. That is to say, the section 64 is not such as would permit the section to stretch over a bead or the like, and then snap into position. Solid wood, especially hardwood, like oak, cannot be made to do that, or at least not without an unacceptable risk of the wood splitting. On the other hand, it is this rigidity of the trim section which permits the section to resist being twisted into easy conformance with the inevitable slight misalignments of the spline, thereby creating the excellent grip as described.

A piece of trim when fitted to a spline as described is excellently secure, and is proof against any normal household knocks etc which might tend to dislodge the trim. The trim is after all in a fairly exposed location, ie around a door, and it would soon be found to be unacceptable if the trim were only lightly held in place, and had a tendency to fall off if subjected to household knocks.

Secure as the grip of the trim to the spline may be, however, the groove 60 is not a tight interference fit on the spline 32; if it were, the wood would have a tendency to split. The groove is nominally size-for-size with respect to the spline. The reason the trim grips the spline is not, as might be thought, because the cross-section of the spline is tight in the cross-section of the groove, or not primarily for that reason. Rather, the spline contacts the sides of the groove only at intervals. Because of the rigidity of the trim section, where contact does occur the contact force is heavy, which gives rise to the high friction with which the trim is held onto the spline.

One point that arises from the fact that the grip between the trim and the spline is so high is that the trim cannot readily be moved longitudinally along the spline. The carpenter must therefore take care to align the trim accurately in the longitudinal sense before pounding the trim into place.

If the mitred edges of the splines are placed close together, ie with no gap between the mitred edges, the line of the mitre can serve as an alignment marker to assist the carpenter to start the trim accurately in position. If the splines are positioned such that a gap is present between the mitred edges (as in FIG. 2) the splines cannot displace each other, but on the other hand the mitre line cannot serve as the alignment marker for the trim. It will usually be preferable to place the pieces of spline in the jig with the mitred edges actually touching: when screwed to the wall, any gap that might have opened between the edges during screwing would be minimal.

The sides of the groove (or the sides of the spline) may be provided with a slight taper or draft angle. The open mouth of the groove is then quite clear on the spline, which makes for easy assembly. As the spline enters the groove, the fit gets tighter. As mentioned, the fit never gets so tight that the wood has any tendency to split.

The taper is not very marked. When the trim is just being applied to the spline, the mouth of the groove is about ½ mm slack with respect to the top 62 of the spline. The taper is such that when the trim is assembled fully down over the spline, the groove is nominally size-on-size with respect to the spline. These dimensions apply to a spline that is 12 mm or so wide.

If the taper is put into the spline rather than into the groove, there might be a danger that the spline could be screwed to the wall wrong side out; this is a minor difficulty, however, because the correct orientation of the spline is indicated by the fact that the outside of the screw-holes in the spline are counter-sunk.

The groove 60 can be made very accurately, when made in a manufactory using precision groove-cutting machinery. Even if the groove has tapered sides, the required accuracy of the cut is within the everyday scope of factory equipment.

The spline 32 can be of wood or plastic. If plastic, it can be extruded accurately. If wood, again attention can be paid in-factory to getting the spline precise as to its dimensions, even if the taper is built into the spline. It may be noted again that not only is the cross-sectional shape 64 of the trim substantially solid and rigid, but the cross-sectional shape of the spline also is substantially solid and rigid, as far as the cross-section itself is concerned. The grip of the trim to a wooden spline does not arise because of any resilience in the cross-sectional profile of either the trim or the spline.

An extruded plastic spline may, however, be provided with a profile having resilient fingers, which grip the inside of the groove with sufficient force to give rise to enough friction to hold the trim firmly on the spline.

FIG. 5 shows the application of the system of the invention to wainscotting, baseboards or skirting boards. Here, the spline piece 65 is screwed through the plasterboard to the sole plate 67 upon which the wall studs are secured. It is customary to leave a gap 68 underneath the baseboard 69 to enable the edge of a carpet to be fitted thereunder.

The spline 65 for the baseboard trim 69 is assembled correctly in place using a jig 70 (FIG. 6), which includes a single length of spline holder. As was the case with the jig 40, the jig 70 is provided with large through-holes 72, through which can pass the heads of the screws which secure the spline 65 to the wall. When the screws, and the spline, are in place the jig 70 is removed. The baseboard trim piece 69 can then be secured by lightly pounding it on, by hand, as was the case with the door trim. The baseboard trim is cut to the correct length prior to fitting, like the door trim.

The jig 70 has a length of about 80 cm. In using the jig, the carpenter starts at one end of the spline 65, locating the screws in position using the jig, and tightening those first screws into the wall. He then removes the jig from the end of the spline, and places the jig over the next portion of the length of the spline.

For ease of operation of the jig, it is preferred that the carpenter be able to slide the jig along the spline; therefore, the fit of the spline to the groove in the jig should have a little more slack than the fit of the spline to the groove in the trim. The fit of the spline to the trim is made tight enough that the trim, once pounded onto the spline, cannot slide along the spline.

If the screw-holes in the spline are pre-prepared, the holes 72 in the jig will have to be aligned with these screw-holes; some carpenters may prefer to make the screw holes through the holes 72 in the jig 70, to avoid having to view when the holes are aligned. It can be quite awkward to make the holes down at floor level, and of course if a drill is used to make the holes in the spline, some debris will be created. When it is preferred to pre-prepare the screw-holes in the spline, an alignment mark can then in fact easily be placed on the spline, to assist in aligning the through-holes in the jig with the screw holes on the spline. The arrangement of the jig as described permits the choice to be made between pre-preparing the holes in the spline, or making the holes in the spline when the spline is on the wall.

As shown in FIG. 6, the jig 70 rests on the floor, and it is this that determines the correct height of the spline 65, and hence of the baseboard trim 69. If the jig 70 is turned upside down, however, it will be inferred that the jig can be placed on top of the carpet, which then serves as the datum point to locate the height of the spline 65. Thus, the jig system may be used for the fitment of new baseboard trim without the need for taking up an existing carpet, and in fact by using the carpet as the datum to set the height of the baseboard trim. The distance from the groove to the face which rests on the floor is about 12 mm greater than the distance, with the jig upside down, from the groove to the face which rests on the carpet.

A further point that may be noted in regard to the splines used to attach baseboard trim is that the splines are available (when the trim is removed) for the attachment of plastic sheets and the like for covering the floor or carpet during decorating. Snap-on clips may be used to attach the plastic sheets to the spline. It is all too common, when protective sheets are laid on the carpet, for a gap to open between the sheet and the wall, and for the carpet to be soiled in that gap.

Figure 7:
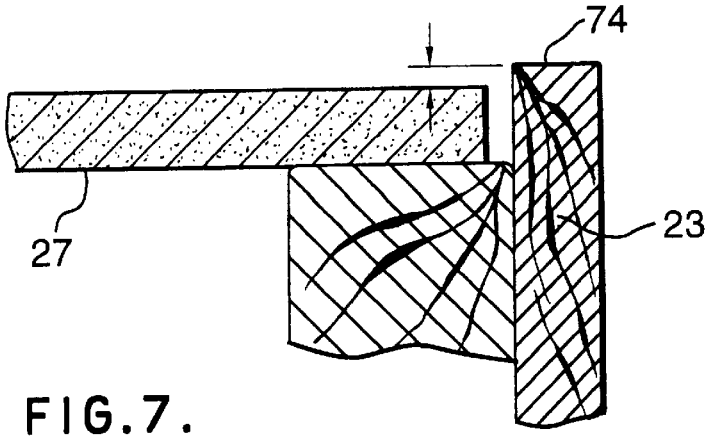
FIG. 7 is a plan view corresponding to FIG. 1, which illustrates a type of misalignment commonly encountered.

As shown in FIG. 7, it often happens that the edge 74 of the door jamb protrudes substantially with respect to the level or plane of the wall. In this case, the trim will not fit neatly flat against the wall as was shown in FIG. 1. What is worse is that the amount by which the edge of the jamb protrudes from the plane of the wall might vary over the height of the door frame. When that is the case, the trim is called upon to be twisted along its length, ie over the height of the door. The trim, being of wood and having a chunky cross-section is highly resistive of such twisting. This means that the grip of the trim to the spline has to be very secure, in order to lock the required (small) amount of twist into the wood.

Figure 8:
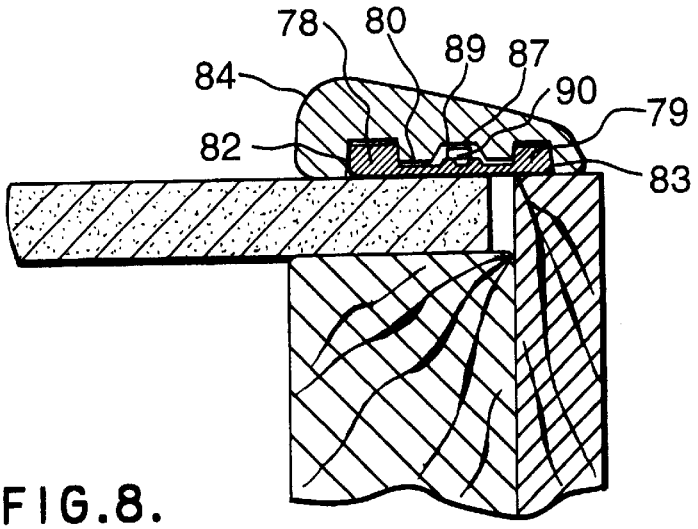
FIG. 8 is a plan view corresponding to FIG. 1, showing a further kind of wood trim assembly which embodies the invention.

This problem can be addressed by providing two splines, together with two corresponding grooves in the trim, as shown in FIG. 8. The two splines 78,79 preferably are joined together by means of a web 80. The web 80 serves to keep the two splines 78,79 at exactly the correct distance apart to enable them properly to engage and grip the grooves 82,83 in the trim 84.

It should be noted that the two grooves 82,83 each grip the two splines 78,79 on both sides, so that there is frictional contact along all four sides of the two splines. It may be considered that the two grooves and two splines arrangement of FIG. 8 is no different from a single, wide, spline and groove, as shown in FIG. 9.

Figure 9:
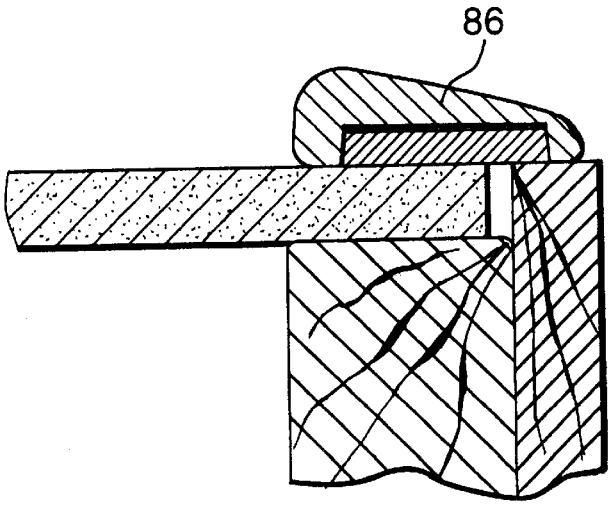
FIG. 9 is a plan view corresponding to FIG. 1, showing yet another kind of wood trim assembly which embodies the invention.

However, the use of a single wide spline 86, as in FIG. 9, is not preferred, firstly because the single spline gives rise to only two contact surfaces. A second reason for not preferring a single wide spline and groove is that wood changes its dimensions quite substantially depending on the amount of moisture in the atmosphere. The grooves and splines shown in FIGS. 1–8 are 12 mm wide, or less, which is small enough that any swellings in the wood are unlikely to have a measurable effect on such a small width. But if the groove and spline are say 30 mm wide, or more, as in FIG. 9, dimensional changes in the wood can start to have a significant effect on the fit of the trim to the spline. It would of course be unacceptable if the trim were to fall off the splines in humid weather. A preferred upper limit on the width of the groove and spline is about 15 mm.

When two grooves 82,83 and splines 78,79 are provided, as shown in FIG. 8, the dimensions of the grooves must be accommodated within the profile of the trim. It is usually the case that the trim slopes inwards towards the door, as shown, so that the groove 83 and spline 79 nearer the door would generally be made slightly smaller than the groove 82 and spline 78 nearer the outer edge. Of course, different profiles of trim have different requirements as to the dimensions of the splines that can be permitted.

If two splines and two grooves are to be provided, the spacing between the splines as the splines are screwed to the wall must be accurately maintained. The provision of the web 80 connecting the two splines is one manner by which accurate spacing between the splines can be achieved. Another way in which the required accurate spacing of two splines can be achieved is by the use of a jig which has two spaced-apart, parallel, spline-receiving grooves cut accurately therein.

In the case of two separate splines, each has to be attached independently. The screws for one spline (equivalent to spline 78 in FIG. 8) pass through the plasterboard and into the stud whereas it is usually more convenient for the screws for the other spline (equivalent to 79) to pass straight into the jamb piece.

In fact, when the two splines are connected by means of the web, it will often also be found advisable to insert screws through the spline directly into the jamb piece.

It sometimes happens that the householder wishes to run electrical wiring along the baseboards of a room, and around a door frame. This can be for the purpose of installing a telephone extension, for instance, or extra loudspeakers. There can also be a requirement to run mains wiring around doors and along baseboards, if such is permitted by local building codes. The system as described particularly lends itself to the easy fitment, and neat concealment, of such wiring. During manufacture of the wood trim, it would be of little consequence to provide, if necessary, a further groove or cut-away section 87 in the profile of the trim, to accommodate the wiring.

In the case of the double spline arrangement shown in FIG. 8, it is especially convenient to accommodate electrical wiring, because a portion 89 of the web 80 can be so shaped as to serve as a datum for aligning the wires 90 to correspond with the position of the wiring cut-out 87 in the trim profile. The wires are secured to the web prior to the trim being secured to the spline.

It is contemplated that the cross-section of the wood trim may be relieved on its back face, such that the trim touches the wall and the jamb piece right at the very edges of the trim. This helps to ensure that the trim fits neatly and without perceptible gaps against the wall surfaces. Although the cross-section is substantially rigid, as described, it is possible for such trim section to be able to "give", very slightly, when being pounded onto the splines, whereby the edges of the splines may engage the wall surfaces with some slight resilience. This slight resilience should however be contrasted with the (impossible) gross resilience that would be needed to allow solid wood to snap over a bead or the like.

The system as described enables trim to be fitted around a door or window, or as a baseboard or skirting board, without the use of nails. This is the case even though the trim is made of oak or other solid, rigid, wood which cannot be flexed or snapped over a bead or location key, or the like.

The fact that nails are not needed means that the trim can be pre-finished, eg in the manufactory where the trim is cut and prepared. The finish can now include very hard-wearing materials, of the kind that are only available if applied in-factory, such as finishes that are baked on, or applied under pressure, or dipped. When the finishing had to be applied after the trim had been nailed to the wall, the types of finishes were practically restricted to the types that could be painted on by hand, with a brush.

Figure 10:
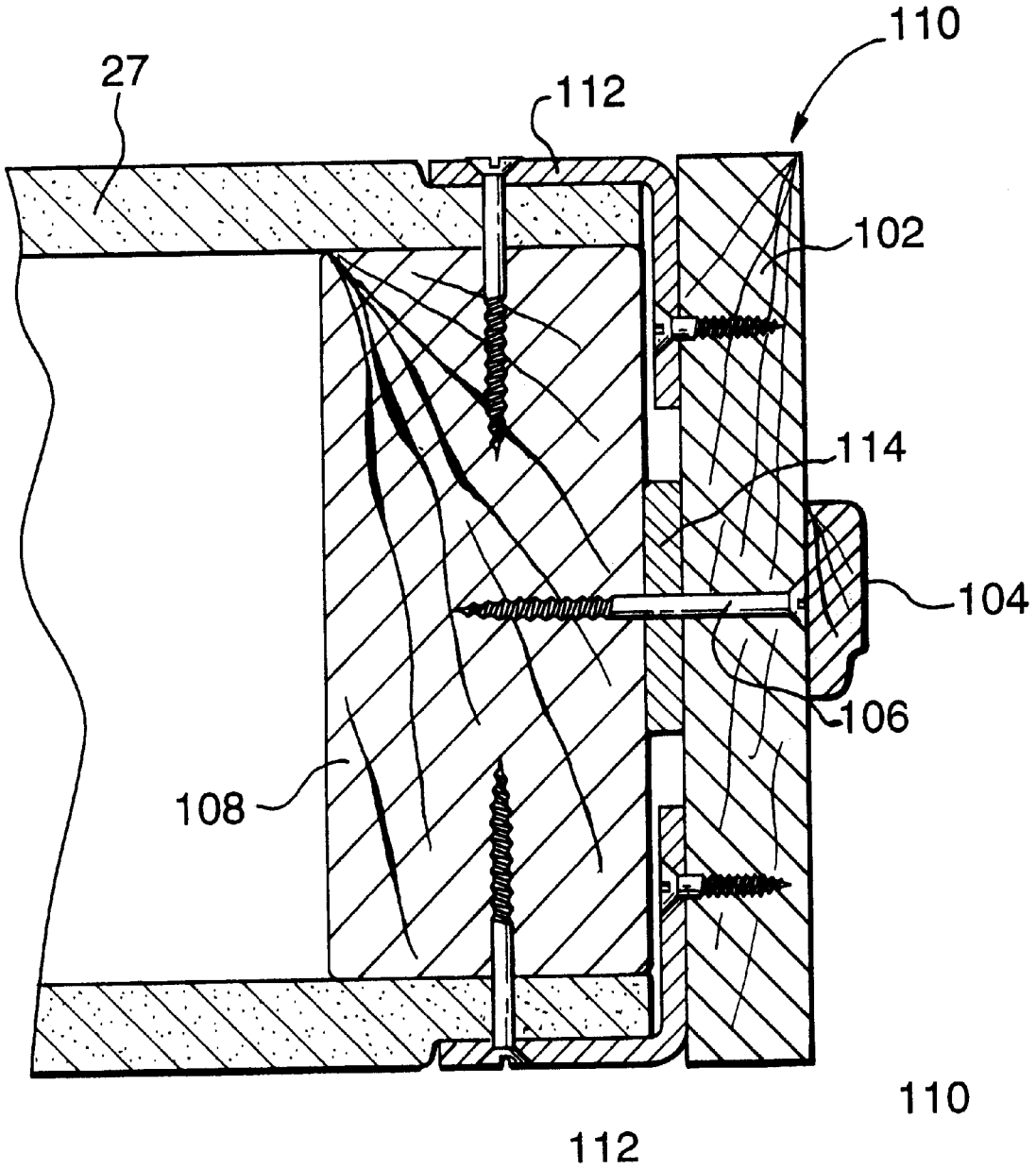
FIG. 10 is a plan view corresponding to FIG. 1, showing a modification to a door jamb, which is advantageous for use in the invention.

The kind of house-holder who seeks to fit solid-wood exposed-grain decorative trim around the doors etc is likely also to favour the use of exposed-grain solid wood not only for the trim but also for the door jambs. Again, one of the problems of using exposed-grain wood is that nail or screw heads must be confined only to those areas which are not open to view. As shown in FIG. 10, in a door jamb 102, most of the surface of the jamb is exposed to view, and therefore cannot receive nail or screw heads. The only zone of the jamb that is concealed is the zone that lies beneath the door stop-trim 104, and a screw 106 can be located underneath this trim, where the head will not show.

However, although the jamb 102 may be firmly held by the screws 106 that go through into the stud 108, the outlying edges 110 of the jamb 102 are somewhat unsupported, and the resulting lack of rigidity of the jamb can be a disadvantage. The situation is better with conventional trim, where some support is given to the outlying edges by the fact that the trim is nailed to the jamb and is nailed also to the wall. Similar support is also given to the outlying edges of the jamb when two splines are provided, as in FIG. 8. When only a single spline is provided, and when that single spline is attached to the wall, the trim that is pounded onto the spline offers little support to the outlying edges 110.

FIG. 10 shows how support can be provided for the outlying areas of the jamb, without resorting to exposed screw heads. In FIG. 10, metal angle-brackets 112 are screwed to the back of the jamb 102, before the jamb is applied to the stud 108. The dimensions of the stud, jamb, etc are such that the outer faces of the angle-brackets 112 lie flush with the outer surfaces of the plasterboard panels 27. When the jamb, with the brackets 112 attached, is applied to the stud 108, the edges of the brackets tear the material of the plasterboard panels in reaching the position as shown in FIG. 10. Of course, the plasterboard material is easily able to be torn and dented locally in this manner, and the torn and dented area will be covered up by the trim.

Often, the stud 108 is not straight and true, and it is a matter of common practice for shims 114 of appropriate thickness to be placed between the jamb 102 and the stud 108. In a case where the stud is badly sloping, for example, the jamb might need to be shimmed out, say, 1 cm from the stud at the top, but may lie against the stud at the bottom. The designer should ensure that the position of the screw holes in the brackets 112 allows for such position adjustment between the jamb and the stud.

In fact, it has been found that the shims 114 can be omitted. If the brackets 112 are strategically located close to the door hinges and latch areas, it has been found that even just a small number of the brackets is sufficient to mount the jambs very solidly indeed, and that screwing the jamb 102 directly to the stud 108, through the shims 114, is not necessary. This is a useful saving because the task of measuring and providing shims of the correct thickness was quite labour-intensive.

The trim, of course, when applied, will cover the brackets. It is important to note that the trim is not nailed to the jamb and therefore the trim cannot aid in supporting the jamb, but this is not a disadvantage because the jamb can be easily and quickly mounted to the stud very solidly using the brackets 112.

With the angle-bracket system as shown in FIG. 10, the trim can be attached by means of the single spline, as described, and yet the jamb is supported from the stud with no less solidity (in fact with more solidity) than when the trim was nailed to both the jamb and the wall.

Figure 11:
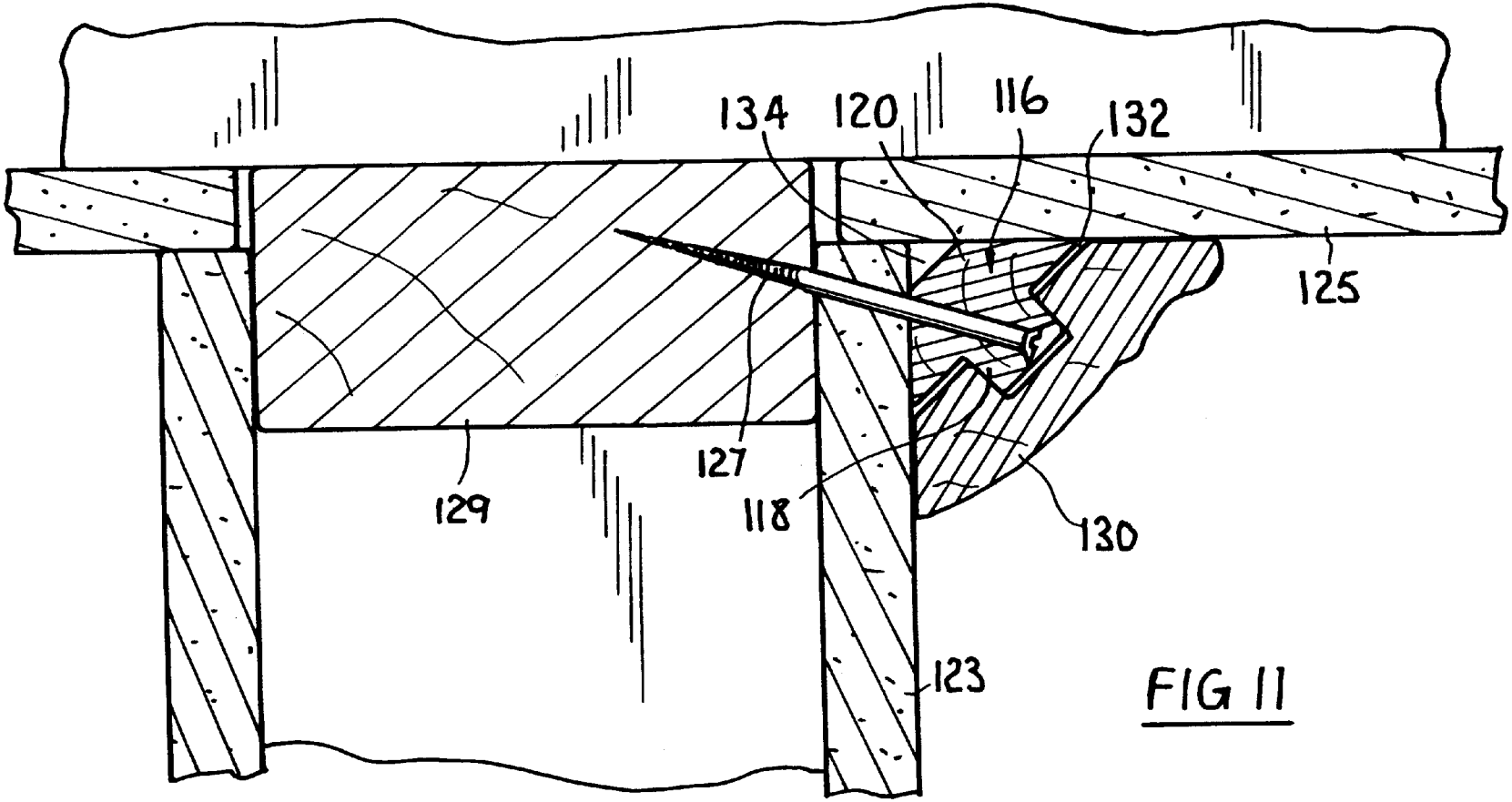
FIG. 11 is a cross-sectional elevation of the top of a wall, showing a corner moulding attached thereto, which embodies the invention.

The trim attachment system, as described, can be used to attach trim to door frames and window frames, and can be used also to attach baseboards or skirting boards. The trim attachment system can also, with a little modification, be used to attach the type of trim used for crown- or corner-mouldings to the corner between the wall and ceiling of a room. FIG. 11 shows a manner in which this may be done.

In FIG. 11, a specially shaped spline piece 116 includes a spline 116 and a body 120. The body 120 is so shaped as to fit into the corner between the plasterboard wall 123 and the plasterboard ceiling 125. Only when the body 120 is in the correct orientation with respect to the corner does the piece 116 fit correctly. A hole for a screw 127 is provided in the piece 116, and the hole is angled so that the screw lies at the angle shown, whereby the screw 127 can be driven into the wooden top plate 129. By tightening the screw at the angle shown, the piece 116 is drawn into the crook of the corner.

The moulding or trim 130 is cut accurately to correspond to the spline 118, whereby, when the trim is applied to the piece 116, the trim lies accurately, without gaps, against the wall and against the ceiling. It will be understood that if the wall and ceiling are slightly curved or otherwise misaligned (as they usually are) the piece 116 will follow the misalignment, and will force the trim also to follow the misalignment, whereby the trim can be expected to fit perfectly all along the length of the corner, ie all around the room. As was the case with the door frame, even though the trim is itself very rigid, the spline takes on the immense rigidity of the wall, and forces the trim to conform to the wall. Of course, the degree of misalignment here discussed is the small degree that is nearly always present in a room that nevertheless looks generally straight and square; the invention is not able to address gross misalignment.

It is these small misalignments that hitherto have troubled carpenters with problems such as the uneven gaps that can occur when working with rigid materials like solid wood trim. Rigid though solid wood trim is, the spline, upon being attached to the wall, is even more rigid, and therefore can force the trim to conform to the wall.

The spline 118 may be separate from the body 120 of the piece 116, but then the accuracy of the location of the spline might be in doubt. Preferably, the piece 116 is unitary; the piece may be a plastic extrusion for example.

As shown in FIG. 11, it is important that the trim 130 should bottom not against the piece 116 but against the wall and ceiling, and the gaps 132 as shown ensure this. It is also important that the piece 116 should not bottom itself into the crook between the wall and the ceiling, since that crook often contains irregularities. The corner of the piece 116 is relieved, at 134 as shown, to ensure this.

It has been stated as a general rule that the splines should be attached to the wall by means of screws. It will be understood that other types of fasteners, such as nails, can be substituted in appropriate cases.

Figure 12:
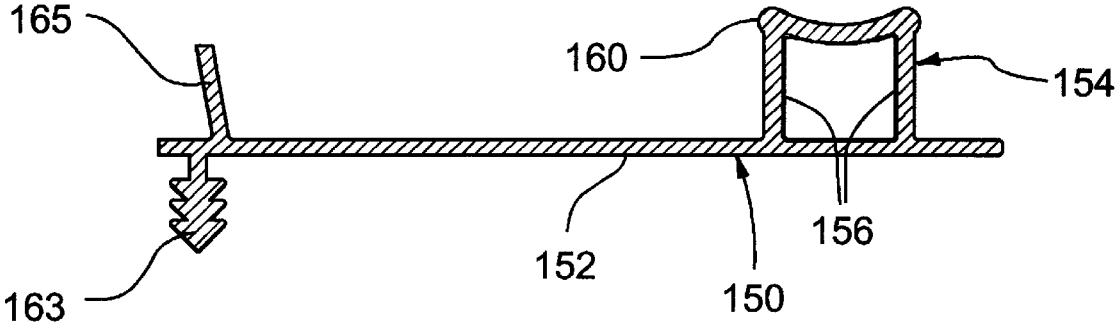
FIG. 12 is a cross-section of a spline-strip, for use in the invention.
Figure 13:
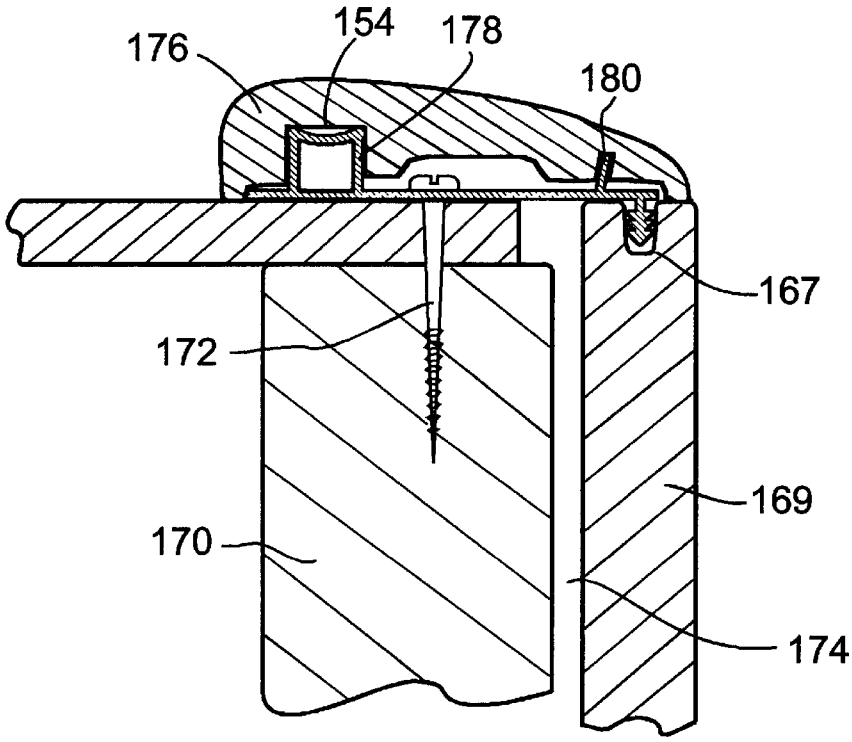
FIG. 13 shows the strip of FIG. 12 in an installation.

FIG. 12 shows a trim attachment strip 150, which is formed as a plastic extrusion. FIG. 13 shows the strip of FIG. 12 in use to attach a piece of wood trim to a wall, associated with a door opening.

The profile of the strip 150 includes a base or web 152, which lies flat against the wall. (The web may be bowed slightly, in profile, so that when the strip is nailed flat to the wall the edges of the profile are pressed against the wall.) Protruding outwards from the web 152 is a spline 154. The spline 154 has the form of a hollow rectangular box, comprising left and right side walls 156 and a roof 158.

The roof 158 is slightly curved, as shown. At the outer corners of the junction between walls and the roof, the profile includes a small, radiused promontory 160. By virtue of the promontories 160, the spline 154 is slightly thicker at its outer end, or roof end.

Protruding inwards (with respect to the wall) from the back of the spline-strip 150 is a protrusion 163. This protrusion is ridged, as shown in FIG. 12.

Protruding outwards from the front of the spline-strip 150 is an inclined rib 165. The rib 165 protrudes not at right angles, but at the slight angular inclination as shown in FIG. 12.

FIG. 13 shows the spline-strip 150 installed. The ridged protrusion 163 engages a groove 167 cut in and along the length of the edge of the (wood) door-jamb-piece 169. By this engagement, the spline-strip 150 and the jamb-piece 169 are locked together against relative lateral movement.

As shown in FIG. 13, the door-jamb-piece 169 is secured in place relative to the door opening by virtue of the fact that the spline-strip 150 is secured to the wall stud 170 by means of screws 172. (Nails, staples, etc, may be used to secure the spline-strip.) The exact position and orientation of the jamb-piece 169 in the opening can be adjusted by adjusting the exact place in which the spline-strip is fixed to the stud.

The jamb-piece as illustrated in FIG. 13 is located at the door-hinge-side of the opening, and it will be understood that the corresponding jamb-piece at the door-open-side of the opening is secured in a similar manner. Also, the jamb-piece of the lintel of the opening is secured in similar manner.

The spline-strip 150, arranged and used as described, provides for a very simple installation of the door-jamb-pieces and the lengths of trim around the door, even though the installer may not be a skilled craftsman. The arrangement as described enables the installation to be done in a manner that make it easy to ensure that the mitred corners of the finishing wood trim will be exactly square and even.

Usually, a door opening is not exactly square and even. The installer may temporarily secure the lintel jamb-piece and spline-strip, and then, with the aid of a set square or jig, align the hinge-side and the open side-jamb pieces and spline-strips. He may install both the inside-the-room and the outside-the-room strips at the same time. Generally, the installer will find that he can easily set the lintel piece first, and then can set the two side pieces exactly at right angles to the lintel piece.

In FIG. 13, it will be noted that no shims are required between jamb-piece and stud in order to hold the jamb-pieces in their correct location in the opening. The jamb-pieces are fully located and constrained by the spline-strips, and by the screws 172. The space 174 is made large enough to accommodate such out of squareness and other unevenness as may be required, to ensure that the jamb-pieces and the spline-strips can be put in place exactly at right angles to each other.

The jamb-pieces 169, spline-strips 150, and the lengths of trim 176, may be pre-made in-factory. The purchaser states the size of the door, and is supplied with the appropriately-sized kit; all the items in the kit are pre-cut to size and all mitres are pre-cut on accurate factory machinery. A kit may be made up of pre-cut and pre-mitred spline-strips; also, pre-cut and pre-mitred lengths of trim (which are not only pre-cut and pre-mitred, but are also fully and finally finished); and also, fully and finally finished jamb-pieces. Since doors come in a limited number of standard sizes, it is economical for wood trim shops to hold stocks of the pre-cut trim, spline-strip, and jamb-pieces in kits for the various standard sizes of door.

The pre-made trim kits provide even the amateur carpenter with a simple way of ensuring that all mitres are not only cut perfectly, but are installed at an accurate right angle. This is in addition to the already-described benefits of the system of the invention: (a) the fact that no nails etc are used to secure the trim means that the trim may be made with a factory-applied finish; and (b) the trim is removable and can be removed and replaced to simplify the task of wall-papering, painting, etc.

In some cases, the installer might wish to remove a sliver of material from the edge of a jamb-piece 169, for example to make the edge lie flush with the wall surface. The grooves 167 should be made deep enough to allow for some material to be removed from the jamb-piece, and still leave the groove deep enough that the ridged protrusion 163 does not bottom in the groove.

The profile of the wood trim 176 may be provided with a space to receive electrical wires running inside the trim. Such wires may be held in place with special clips, which hook into holes drilled in the web of the spline-strip.

The trim 176 is provided with a spline-groove 178 and a rib-groove 180. To install the trim to the spline-strip 150, the length of trim is first assembled over the leaning rib 165; the rib 165 bends slightly when the trim is pressed down over the spline 154, resulting in a (slightly) heavier contact force between the rib 165 and the trim 176, and a force which tends to draw the edge of the trim into a slightly tighter contact with the jamb-piece.

The spline-groove 178 and the spline 154 have a slight interference fit, especially over the roof-end of the spline, where, as mentioned, the spline is slightly thicker because of the corner promontories 160. The roof 158 is able to bend (in a buckling mode), to the extent required for the spline 154 to fit in the groove 178 with a good contact force.

The hollow-box form of the spline 154 profile is excellent in providing just the right degree of stiffness and resilience in the spline.

It may be noted that if the spline were solid, only a very limited degree of interference between the spline and the spline-groove could then be allowed—typically about 0.01 mm maximum. The designer dare not provide more interference than that, or the spline-groove 178 in the trim may tend to crack open.

The solid-spline system as described with reference to FIGS. 1–11 is able to provide excellent retaining and holding power of the trim to the spline, even though the spline has only a light interference, hardly any interference, or no interference at all, with the spline-groove. However, when the spline is made of plastic, in the form of an extrusion in PVC, for example, the coefficient of friction between the PVC of the spline and the wood of the spline-groove can be low enough that the designer wishes to resort to interference to provide the holding power needed.

Heavy interference cannot be contemplated when the spline is solid. A solid spline has too little resilience, and if the interference is just slightly too much, the wood trim will crack. On the other hand, if the "spline" were to take the form of two protruding arms, side by side, and cantilevered out from the web, the resilience of the arms would then be too much: it would not be possible to develop enough contact force between such arms and the sides of the spline-groove to give enough holding power.

It may be regarded that in the hollow-box profile of the spline the roof 158 serves to hold the outer ends of the left and right walls 156 apart. The roof 158 is resilient enough, in the bending/buckling mode, to allow the walls to bend inwards slightly, if the groove should be cut narrow, and yet enough interference is provided to ensure good holding power if the groove should be cut on the wide end of its permitted tolerance range. This just-right degree or rate of resilience of the spline is enhanced if the roof 158 is given the preliminary curvature, as shown.

The thickness of the roof can be adjusted, also, to provide just the right degree of resilience: it has been found that making the roof slightly thinner than the walls can help give the right balance between a too-hard spline, which has no give, and splits the wood trim if the groove is slightly too tight, and a too-soft spline, in which the spline does not provide enough grip to the sides of the groove. The hollow-box design of spline enables the spline to grip the trim tightly enough for good securement, over a tolerated range of groove widths.

The degree of resilience attributable to the hollow-box profile of the (plastic) spline may be expected to provide holding power over a tolerance range of the order of 0.02 mm.

The hollow-box profile allows more interference between spline and spline-groove than was the case with the solid spline. In the context of plastic splines:—on the one hand, a solid plastic spline has hardly enough resilience to permit any interference; on the other hand, two cantilevered arms would have too much resilience. But two cantilevered arms joined by a roof (which is what the hollow-box profile amounts to) has just the right degree of resilience to provide a good holding force without demanding difficult-to-manufacture tolerances. Interference-fits generally require tight tolerances: the hollow-box profile for the plastic spline eases that requirement enough that a factory-cut groove in a length of solid oak or other wood trim can be accurate enough.

A problem that can sometimes arise with mitred corners is that the wall is not quite flat in the plane of the wall. As a result, at a mitred corner, the horizontal lintel trim might protrude perhaps a half-millimeter further out from the wall than the vertical trim. Even though the mitre might be exactly a right angle, such protrusion-mismatch can be quite noticeable.

Figure 14:
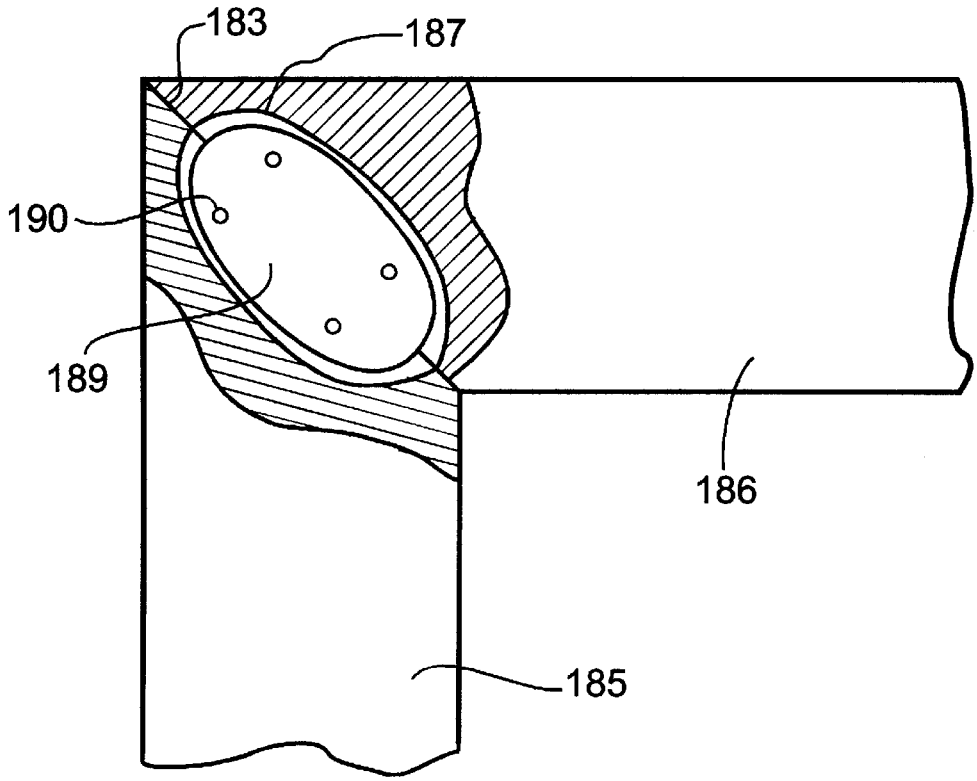
FIG. 14 shows a mitred corner between two lengths of trim.

FIG. 14 shows how the lengths of trim may be joined together at the mitred corners, in a way that eliminates protrusion-mismatch. The mitred edge 183 of the vertical length of trim 185, and the corresponding mitred edge of the horizontal length of trim 186, are provided with slots 187, into which is inserted a biscuit 189. The biscuit 189 is a piece of hardwood or plastic sheet formed to the oval shape as shown. The biscuits may be glued in place, or, if the trim profile is of appropriate thickness, the biscuits may be screwed in place, as at 190. Of course, the screws are screwed in from the back of the trim, and must be short enough not to extend right through the trim.

The trim lengths 185,186 are secured together before being placed on the wall. This means that the installer must be able to rely on the accuracy of the mitres, as cut, in both the trim lengths and the spline-strips. It will be understood that securing the trim-lengths together with biscuits, and then placing the secured-together trim-lengths on the spline-strips, poses a very demanding requirement for accuracy of the mitres and of the dimensions of the pieces. However, such accuracy is available if the mitred joints between the trim lengths and the spline strips are factory-made to suit the particular door size. The pre-grooved door-jamb-pieces 169 should be included also in the same kit.

It is recognised that the in-factory-accuracy of making the mitred joints in this way is not wasted nor compromised, even if the door opening is (as they usually are) not truly accurate and square.

It is convenient to join the lintel trim-length to the two vertical trim-lengths, by means of the biscuit connectors, just before the sub-assembly comprising the three trim-lengths is applied to the already-installed spline-strips. The sub-assembly of the three trim-lengths is awkward, and vulnerable to transit damage; however, a professional trim installer may be willing to take the trouble to handle the vulnerable assembly with the needed care, in exchange for the benefits of pre-making and pre-gluing the biscuit connectors in-factory.

Pre-making the sub-assembly of the trim-lengths by pre-gluing biscuit connectors into the joints is much more efficacious in the case of window trim. With window trim, there are four lengths of trim, in the form of an enclosed rectangle. A window trim sub-assembly, being an enclosed rectangle, is much more robust than a door trim sub-assembly, and can be expected to survive handling by amateur craftsmen. However, it will be appreciated that the need for accurate cutting of the lengths and of the mitre angles is very pressing when the trim is installed as a sub-assembly onto the already-installed spline-strips; such pre-making of the sub-assembly is only possible when the pieces are supplied together, in a kit, having been made on accurate machinery.

In fact, if there is protrusion-mismatch of the trim-lengths at a mitred joint because the wall surface is not quite flat, the two spline-strips making up the joint also may be expected to have the mismatch. Indeed, in some cases, if the mismatch of the spline-strips is eliminated, there will be no need to cater for mismatch in the trim itself. Certainly, the installation and attachment of the trim lengths (and the possible detachment if the trim-lengths at some future time) is much more convenient if the trim-lengths are not permanently glued together as a pre-made sub-assembly.

Figure 15:
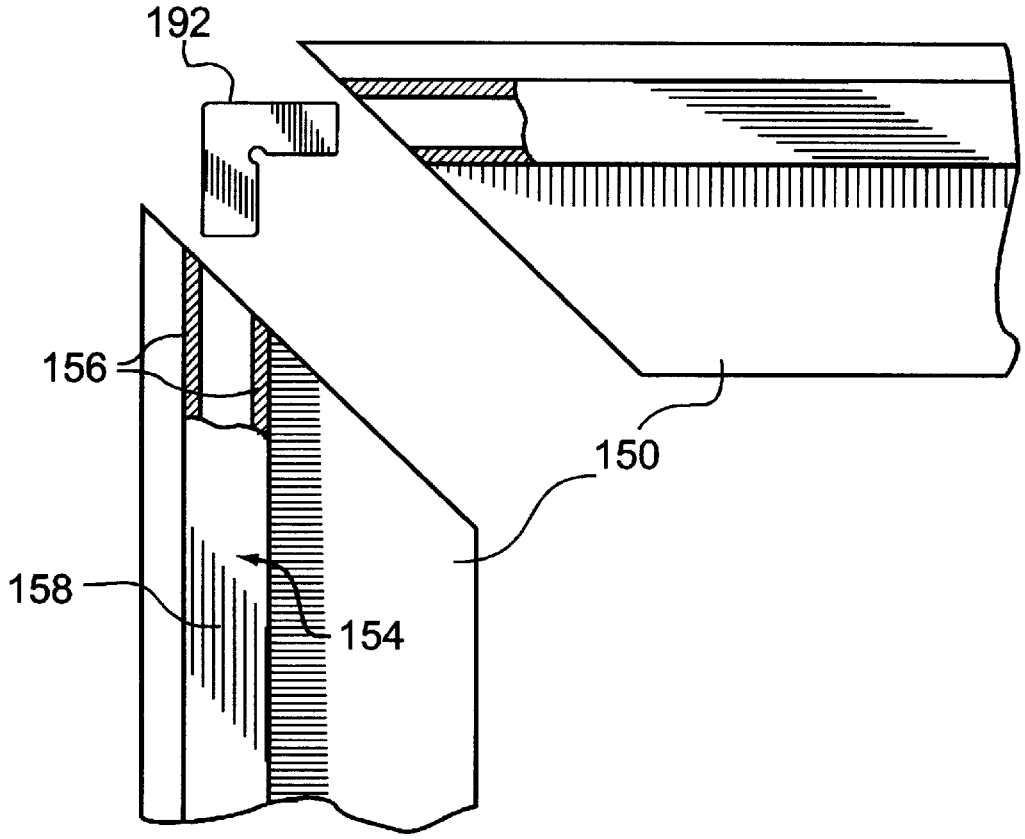
FIG. 15 shows a mitred corner between two spline strips.

Catering for possible protrusion-mismatch between mitred spline-strips is very simple, in view of the hollow-box profile of the spline-strip. As shown in FIG. 15, injection-moulded plastic corner-pieces 192, having a rectangular form which fits the hollow interior of the spline 154, are inserted into the splines at the mitred corners. When the spline-strips 150 are screwed or nailed to the wall, the corner-pieces 192 constrain and hold the two spline-strips at the same protrusion level, even if the wall should be (slightly) uneven.

The corner-pieces 192 may serve in this way equally for door trim as for window trim.

More than one spline or rib may be provided on the strip, having also a hollow interior, and corresponding corner pieces may be provided for that also.

A preferred way of installing the trim and its mounting system may be described as follows. The lengths of trim, the spline-strips, and the door-jamb-pieces, are all, pre-mitred, and pre-finished, in-factory, and are purchased by the installer as a kit for a particular width of door, or door opening. The kit is opened in the room, and the door-jamb-pieces are assembled, on edge, on the floor. The spline-strips for the inside of the room are assembled to the door-jamb pieces; the ribbed protrusions 163 are entered into the groove 167 while the jamb-pieces are still laid on the floor.

The door-jamb pieces may now be secured together at the mitred corners, using appropriate fasteners. (Of course, these fasteners should be so arranged as not to be visible after installation.)

The assembly comprising the fixed-at-the-corners jamb-pieces and the inside-the-room spline-strips, which are already assembled to the jamb-pieces, may now be lifted off the floor of the room, and the assembly placed in the door opening. The installer will generally be able to tell, by eye, by looking at the mitred corners, both of the jamb-pieces and of the spline-strips, whether the corners are accurately at right angles. It may be regarded that if the installer cannot see any out-of-squareness at the corner by looking at the line of the mitre, then the out-of-squareness is so small it can be ignored. Set squares and other instruments are generally not required. The installer must be able to "trust" the mitres for squareness, but this is acceptable with factory-made mitres.

The spline-strips are secured to the wall when the installer is satisfied, but looking at the lines of the mitres, that the corners are square. The door jamb-pieces are secured by securing the spline-strips to the wall. Once the inside-the-room spline-strips are secured, the outside-the-room spline-strips may be installed, using the grooves 167 cut in the far edges of the jamb-pieces. The outside-the-room spline strips are secured to the wall also.

The jamb-pieces and the spline-strips having been installed with accurately-square corners, in this manner, the lengths of wood trim may now be assembled to the splines. The installer may be confident that the mitred corners of the wood trim will look square (and indeed will be square), provided the installer took a little trouble to ensure the mitred corners of the spline-strips looked square.

When installing the spline-strips and the wood trim in a case of renovation, rather than original installation, it will generally be impractical for the jamb-pieces to be provided with grooves 167. For renovation work, therefore, the spline-strip is provided without the protrusion 163.

Even though, for renovation, there is no protrusion-in-groove engagement between the jamb-pieces and the spline-strips, out-of-squareness of the door jamb can be accommodated (within limits) simply by the placement of the spline-strips. For renovation, the installer relies on looking at the line of the mitre to indicate when the spline-strips are square; he does not rely on the alignment of the strips with the existing door (or window) jamb. The installer looks at the line of the mitre (a distance of about 8.5 cm if the spline-strips are 6 cm wide) and makes sure the mitre line appears to be the same thickness all along its length. With only a minimal skill, the installer can fix the spline-trim with its corners square enough that the corners in the finished wood trim, when the wood trim comes to be pressed onto the splines, appear to be perfectly aligned.

Figure 16:
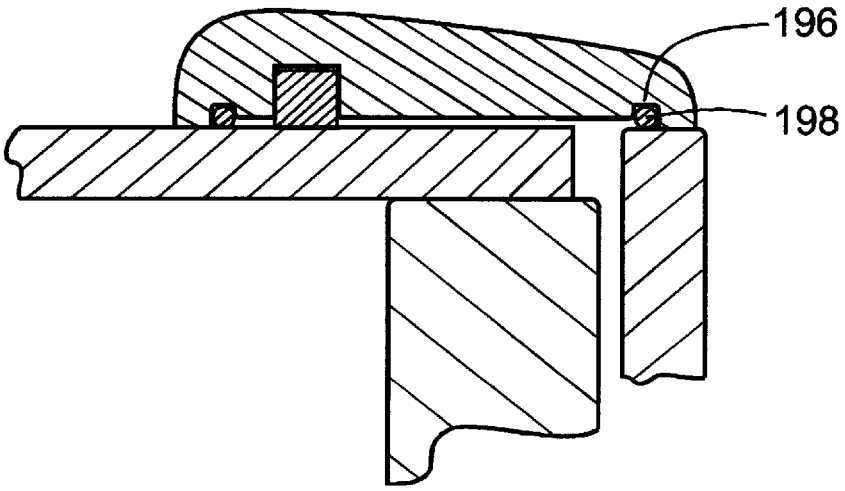
FIG. 16 shows trim to which draft-excluding seals have been added.

FIG. 16 shows a useful variation to the trim, in which further grooves 196 are provided in the cut-profile of the trim. Rubber sealing strips 198 are carried in the grooves 196, and serve to prevent drafts which may be emanating from inside the (hollow) wall and from the space 174, from leaking around the trim.

Figure 17:
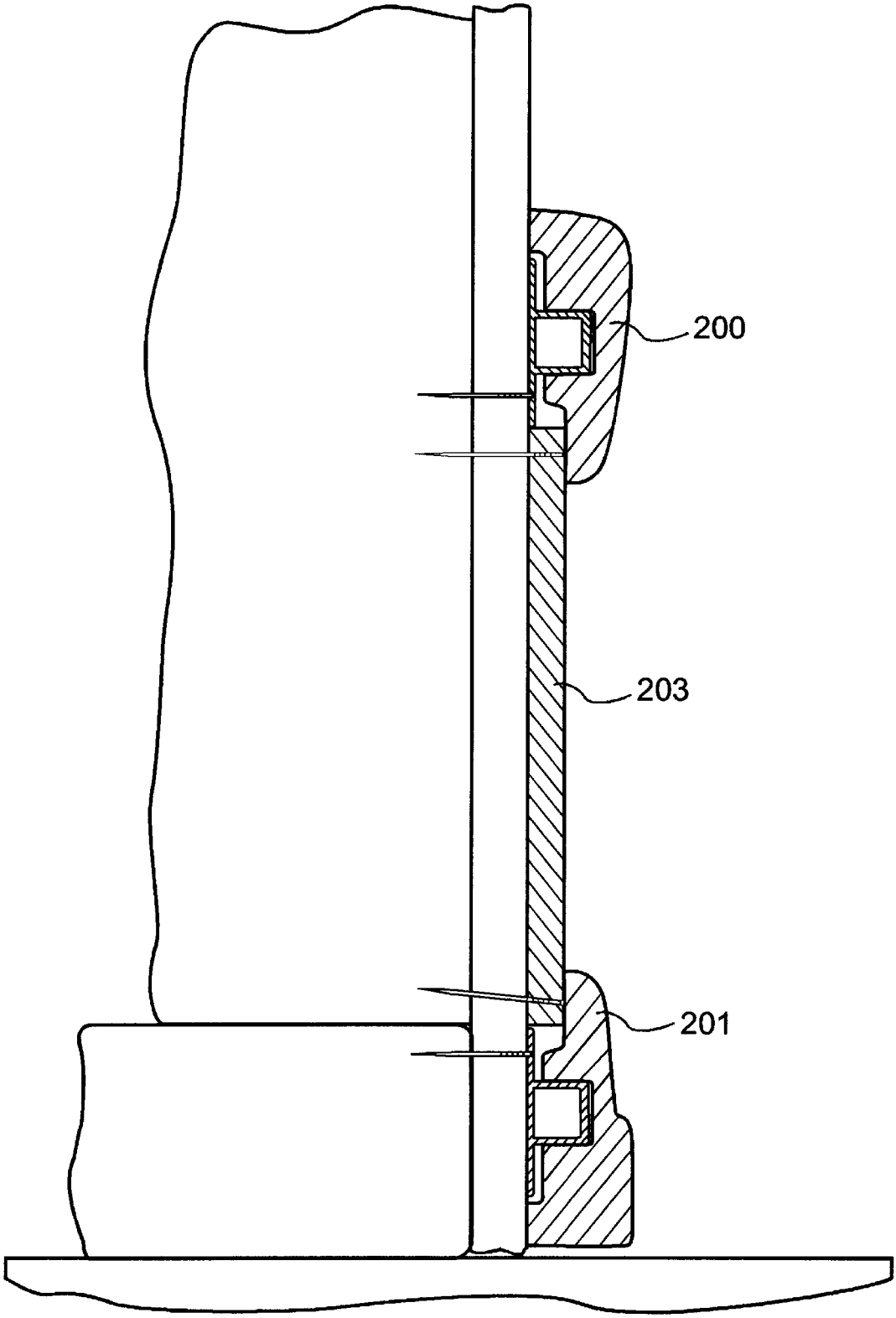
FIG. 17 shows trim applied to a baseboard.

FIG. 17 shows another manner in which the invention may be applied: for wide trim, such as may be required for a baseboard, the trim may be provided in, for example, three sections. The outer two sections 200,201 are attached by means of the spline attachment system of the invention, whereas the middle section 203 is screwed in place. Normally, the screws holding the middle section remain concealed by the outer two sections. When decorating the room, the outer two sections, being spline-held, can be removed. A similar arrangement may be employed also for crown moulding trim, ie trim for the corner between wall and ceiling, as in FIG. 11.

What is claimed is:

1. Wood trim assembly, which is suitable for attaching solid wood door and window trim, wainscotting, baseboard trim, or corner moulding, to a wall, characterised in that:

the assembly includes lengths of solid wood trim, and lengths of spline;

each length of wood trim is of constant cross-section along its length;

each length of spline is of constant cross-section along its length;

each length of trim is assemblable to a respective length of spline;

each length of the solid wood trim includes a back face which is adapted to lie against the wall, and a decorative front surface;

the shape of the cross-section of the solid wood trim includes a groove formed into the cross-section of the trim from the back thereof;

the spline is adapted to fit inside the groove in the trim, in that the cross-section of the groove is complementary in shape and size to the cross-sectional shape and size of the spline;

the spline is adapted to be fixed firmly to the wall, prior to the trim being assembled to the spline;

the fit of the spline to the groove in the trim is such that, upon assembly of the trim to the spline, the spline being fixed firmly to the wall, the trim is assemblable over the spline by means of a manual pounding action, whereby the trim, after assembly, remains firmly held in place by means of its frictional grip on the spline, and whereby the use of nails or glue to hold the trim is avoided;

the spline is formed with a pair of opposed, outwardly-facing, side surfaces;

the groove is formed with a complementary pair of opposed, inwardly-facing, side surfaces;

the spline is formed with a top surface, being a surface of the spline which lies between the side surfaces, and which, when the spline is fixed to the wall, faces away from the wall;

the groove is formed with a bottom surface, being a surface of the groove which lies between the side surfaces of the groove, the fit of the groove relative to the spline is such as to comprise, upon assembly of the groove to the spline, a means for ensuring the side surfaces of the spline fit together, and lie in close operational gripping engagement with the side surfaces of the groove;

the fit of the groove relative to the spline is such as to comprise, upon assembly of the groove to the spline, a means for ensuring the top surface of the spline and the bottom surface of the groove lie substantially clear of each other;

the form of the spline and of the groove in the trim are such that, when the spline is fixed to the wall, and the trim is assembled on the spline, the said opposed side surfaces of the groove and of the trim lie at a substantial angle with respect to the plane of the wall.

2. Assembly of claim 1, wherein the fit of the groove to the spline, after assembly, across the width of the groove, is between zero clearance and ¼ mm clearance.

3. Assembly of claim 2, wherein one of either the groove or the spline is tapered, to the extent that the clearance between the groove and the spline, upon presentation of the groove to the spline just prior to assembly is about ½ mm.

4. Assembly of claim 2, wherein the groove is less than about 15 mm in width.

5. Assembly of claim 1, wherein the cross-sectional shape of the trim, with the groove therein, is characterised as chunky and rigid.

6. Assembly of claim 1, wherein the spline is a plastic extrusion, and the cross-sectional shape of the spline includes resilient fingers which, upon assembly of the trim to the spline, engage, and press resiliently against, the sides of the groove.

7. Wood trim kit, comprising a combination of the assembly of claim 1, together with a jig, the jig being suitable for assisting in the placement of the spline in the desired location upon the wall.

8. Kit of claim 7, wherein:

the jig includes a spline holder, in which is formed a jig-groove, the jig-groove being complementary in cross-sectional size and shape to the spline;

the jig is provided with through-holes, which are so positioned and arranged that screws can pass therethrough and through a spline positioned in the jig-groove, the through-holes being large enough that the heads of the screws can pass therethrough.

9. Kit of claim 8, wherein:

the jig includes two such spline holders, and the jig includes a brace for holding the two holders precisely set at right angles to each other;

and the jig includes an abutment piece, which is so arranged as to provide an abutment for locating and positioning the jig flat against the jamb of a door frame.

10. Assembly of claim 1, wherein:

the assembly includes a pair of the said grooves and a complementary pair of the said splines, the splines and grooves being arranged in spaced-apart, parallel, side-by-side relationship;

and the splines are linked by a web means, which is effective to hold the splines precisely in the said relationship.

11. Assembly of claim 1, wherein the shape of the cross-section of the solid wood trim includes a cut-out which is suitable for receiving electrical wiring passing along the length of the trim.

12. Assembly of claim 1, wherein the groove and the spline are plain-sided, in that the sides of the grooves and splines include no protrusions or beads or re-entrant aspects, and in that the fit of the trim to the spline is such that the wood of the trim is not, in substance, required to flex resiliently, upon engagement.

13. Assembly of claim 1, wherein:

the spline is integral with a spline piece body, the body being shaped for fitment into the crook of the corner between the wall and ceiling of a room;

and the trim comprises corner moulding, which is adapted for fitment into the crook of the corner between the wall and ceiling of a room.

14. Assembly of claim 1, wherein the assembly includes a door jamb, and includes a plurality of angle brackets, which are fixed to the door jamb, and by which the door jamb may be fixed to the wall.

15. Assembly of claim 1, wherein the distance apart of the side surfaces of the spline is, in substance, not more than the distance apart of the side surfaces of the groove, whereby the fit of the spline to the groove, when assembled, at a particular cross-sectional location thereof, is not an interference fit.

16. Procedure for attaching solid wood door and window trim, baseboard trim, or corner moulding, to a wall, wherein:

the procedure includes the step of providing lengths of solid wood trim, and lengths of spline;

the procedure includes the step of providing a groove in the trim which is complementary in cross-sectional size and shape to the cross-section of the spline;

the procedure includes the step of fixing the spline solidly to the wall by means of fasteners;

the procedure includes the step of applying the trim over the spline, whereby the groove in the trim engages the spline;

the spline is formed with a pair of opposed, outwardly-facing, side surfaces;

the groove is formed with a complementary pair of opposed, inwardly-facing, side surfaces;

the spline is formed with a top surface, being a surface of the spline which lies between the side surfaces, and which, when the spline is fixed to the wall, faces away from the wall;

the groove is formed with a bottom surface, being a surface of the groove which lies between the side surfaces of the groove, the groove and spline are so dimensioned and arranged that, upon assembly of the groove to the spline, the side surfaces of the spline fit together, and lie in close operational gripping engagement with the side surfaces of the groove;

the fit of the groove relative to the spline is such as to comprise, upon assembly of the groove to the spline, a means for ensuring the side surfaces of the spline fit together, and lie in close operational gripping engagement with the side surfaces of the groove;

the fit of the groove relative to the spline is such as to comprise, upon assembly of the groove to the spline, a means for ensuring the top surface of the spline and the bottom surface of the groove lie substantially clear of each other;

and the procedure includes the step of so dimensioning the groove and the spline that, upon engagement, the sides of the groove are in contact with the sides of the spline, thereby creating a frictional resistance to the dislodgement of the trim from the spline.

17. Trim-mounting strip, for the attachment of wood trim to a wall, wherein:

the strip is of plastic, and is elongate, and comprises a unitary structure having the same cross-sectional profile at all points along its length;

the cross-sectional profile includes a base or web, which is flat, and is adapted for direct application to a flat surface of a wall;

the cross-sectional profile includes a spline which, when the strip is applied to a wall, protrudes from the wall;

the spline includes left and right side wall components, and a roof component;

and the components of the spline are arranged to form a hollow box-shaped enclosure.

18. Strip of claim 17, in combination with a length of wood trim, wherein:

the trim is a unitary structure having the same cross-sectional profile along its length;

the cross-sectional profile of the trim includes a groove, and the groove is sized to be an interference fit on the spline.

19. Combination of claim 18, wherein the combination includes vertical-lying and horizontal-lying lengths of trim, and corresponding strips, the lengths and strips being all pre-cut and pre-mitred, and accurately matched.

20. Combination of claim 19, wherein the vertical-lying and horizontal-lying lengths of trim are pre-formed into a sub-assembly.

21. Combination of claim 20, wherein the sub-assembly of horizontal-lying and vertical-lying lengths forms an enclosed rectangle, the combination being suitable for installation around a window.

22. Combination of claim 19, wherein the combination includes also corresponding door-jamb-pieces, all pre-cut and pre-mitred and accurately matched;

the jamb-pieces are provided with grooves along the edges thereof;

the spline-strips are provided with protrusions, located on the back of the web, which engage the grooves in the edges of the jamb-pieces.

23. Combination of two strips as claimed in claim 17, and a corner piece;

the corner piece is profiled to fit snugly inside the hollow interiors of the splines of the strips, and is so shaped that, when placed in the hollow interiors of the two strips arranged in a 90-degree mitred corner, the corner-piece is effective to hold and constrain the strips in the said mitred corner against relative movement.

24. Assembly of claim 1, wherein the trim is provided with draft-excluding seals, arranged to contain drafts within the wall.

* * * * *